United States Patent [19]

Brennan

[11] Patent Number: 4,733,910

[45] Date of Patent: Mar. 29, 1988

[54] ARTICLE OF FURNITURE

[75] Inventor: James W. Brennan, Bankstown, Australia

[73] Assignee: Sebel Furniture Ltd., Bankstown, Australia

[21] Appl. No.: 840,348

[22] Filed: Mar. 17, 1986

[30] Foreign Application Priority Data

Mar. 18, 1985 [AU] Australia ..... PG9777

[51] Int. Cl.[4] ..... A47C 5/12; A47C 7/44

[52] U.S. Cl. ..... 297/300; 297/285; 297/306; 297/DIG. 2

[58] Field of Search ..... 297/285, 296, 297, 299, 297/300, 353, 354, 457, DIG. 2, 306

[56] References Cited

U.S. PATENT DOCUMENTS

| | | | |
|---|---|---|---|
| 3,031,227 | 4/1962 | Van Buren, Jr. | 297/DIG. 2 X |
| 3,669,496 | 6/1972 | Chisholm | 297/DIG. 2 X |
| 4,032,190 | 6/1977 | Muller-Deisig et al. | 297/300 X |
| 4,169,628 | 10/1979 | Wolf et al. | 297/DIG. 2 X |
| 4,333,683 | 6/1982 | Ambasz | 297/300 X |
| 4,529,247 | 7/1985 | Stumpf et al. | 297/DIG. 2 X |
| 4,557,521 | 12/1985 | Lange | 297/285 |

*Primary Examiner*—Kenneth J. Dorner
*Assistant Examiner*—Peter R. Brown
*Attorney, Agent, or Firm*—Townsend & Townsend

[57] ABSTRACT

The present invention discloses a chair having a seat and a backrest which is hinged to the seat by a resilient hinge. The hinge is substantially moulded together with the shell formed by the seat and backrest. The degree of flexure of the backrest exceeds any flexure of prior art. One piece plastic shells and stops are preferably provided to limit the degree of flexure of the hinge. Moulding the hinge with the shell substantially reduces costs.

8 Claims, 19 Drawing Figures

ARTICLE OF FURNITURE

The present invention relates to chairs and, in particular, to a moulded plastics chair in which the backrest and seat are moulded as a single shell and, in addition, the backrest is flexible with respect to the seat.

Plastics chairs in which the seat and backrest are moulded as a single shell are well known, the chair normally being provided with metal legs. In some instances where the shell is not itself very strong, the shell is mounted on a metal frame which transfers the weight of the sitter from the shell to the legs.

A moulded plastics shell incorporating both the seat and the backrest has many advantages in the manufacture of chairs, particular in relation to reducing the cost of the chair and reducing the time taken by, and complexity of, the assembly procedures. In manufacturing such chairs, it has hitherto been highly desirable to avoid the backrest being flexible with respect to the seat. Where a metal frame has been provided, such flexibility is substantially negligible. However, where a metal frame is not provided for the shell, there will be some small degree of flexibility between the seat and the backrest. However, this flexibility arises merely because of the flexibility of the material used to fabricate the shell and is not the result of a specific constructional feature of the shell. In addition, because of the tendency of some plastics to fatigue with repeated flexure, such flexibility is undesirable and tends to shorten the life of the shell.

It is also desirable in the manufacture of chairs if a chair can be provided in which the backrest is flexible with respect to the seat and able to be rearwardly inclined in an anatomically correct manner by the rearward movement of the back of a sitter about a horizontal axis located adjacent the lower portion of the back of the sitter. Such a chair has more "give" and is therefore more comfortable, particularly where the sitter remains seated for long periods. Many constructions have been proposed in order to provide for this desired flexibility, however, such arrangements are fabricated with the backrest and the seat being made as separate pieces and being interconnected by a separate resilient hinge arrangement often of complex mechanical construction.

It is the object of the present invention to provide a moulded plastics chair in which the seat and backrest are moulded as a single shell and which, in addition, provides for flexibility of the backrest relative to this seat through the action of a constructional feature moulded into the shell.

According to one aspect of the present invention there is disclosed a moulded plastics chair having a seat and a backrest moulded as a single shell with said backrest being connected to said seat by a resilient hinge means substantially moulded together with said shell; wherein said backrest is moveable by the action of said hinge means between a rest position adopted by the backrest in the absence of a sitter, and a rearwardly inclined position into which said backrest is resiliently urged by rearward movement of the back of a sitter.

One embodiment of the present invention will now be described with reference to the drawings in which.

Figure 1:
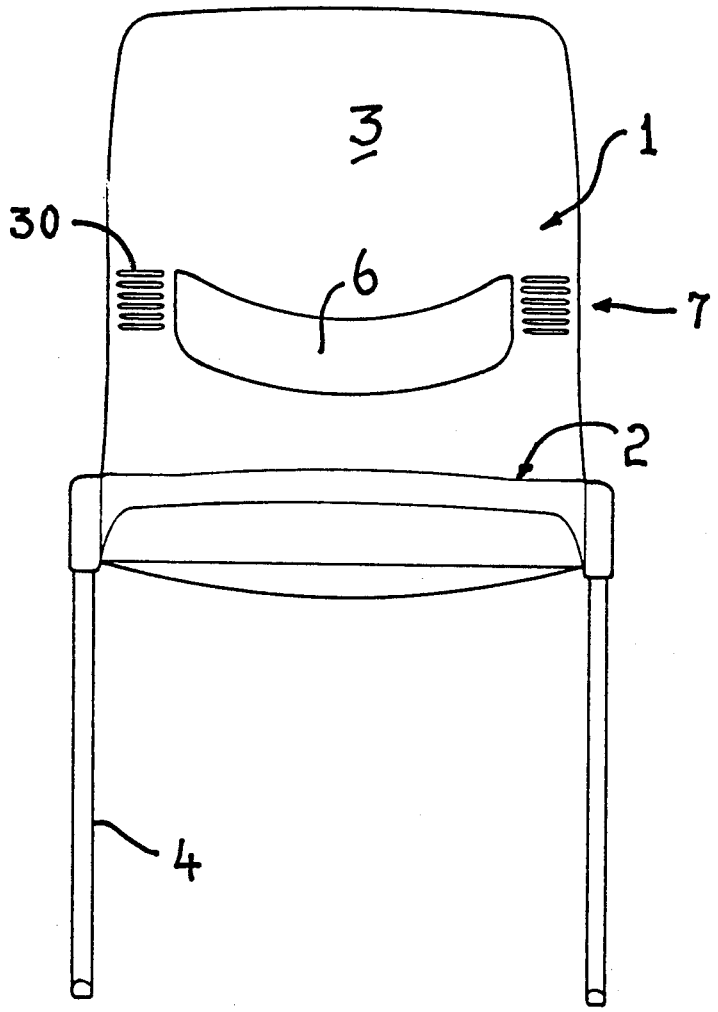
FIG. 1 is a front elevation of the chair of the preferred embodiment.
Figure 2:
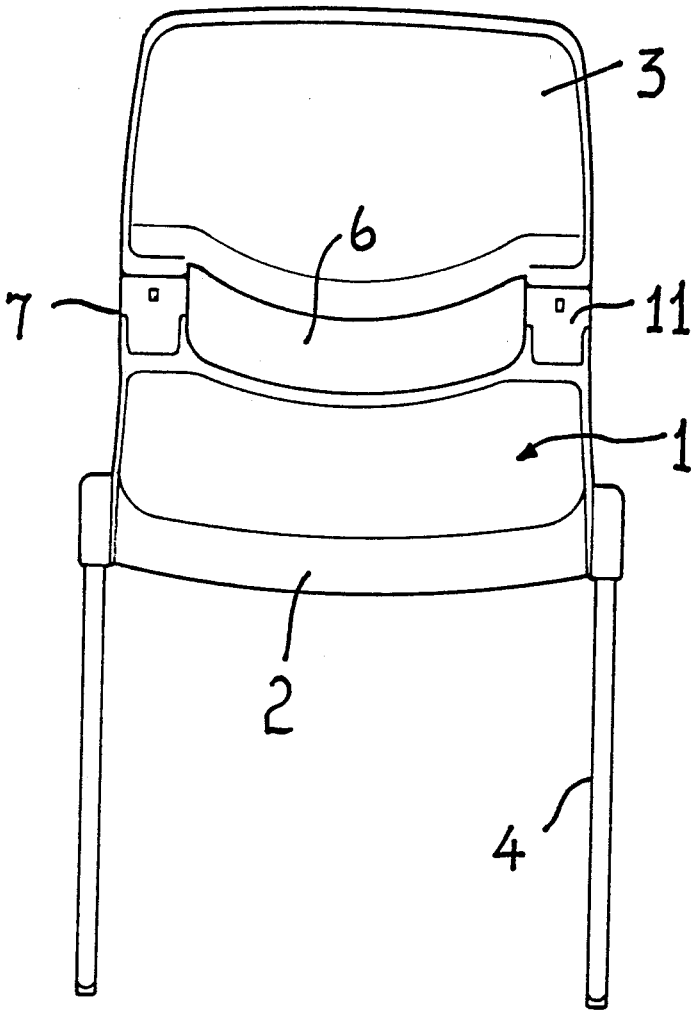
FIG. 2 is a rear elevation of the chair of FIG. 1.
Figure 4:
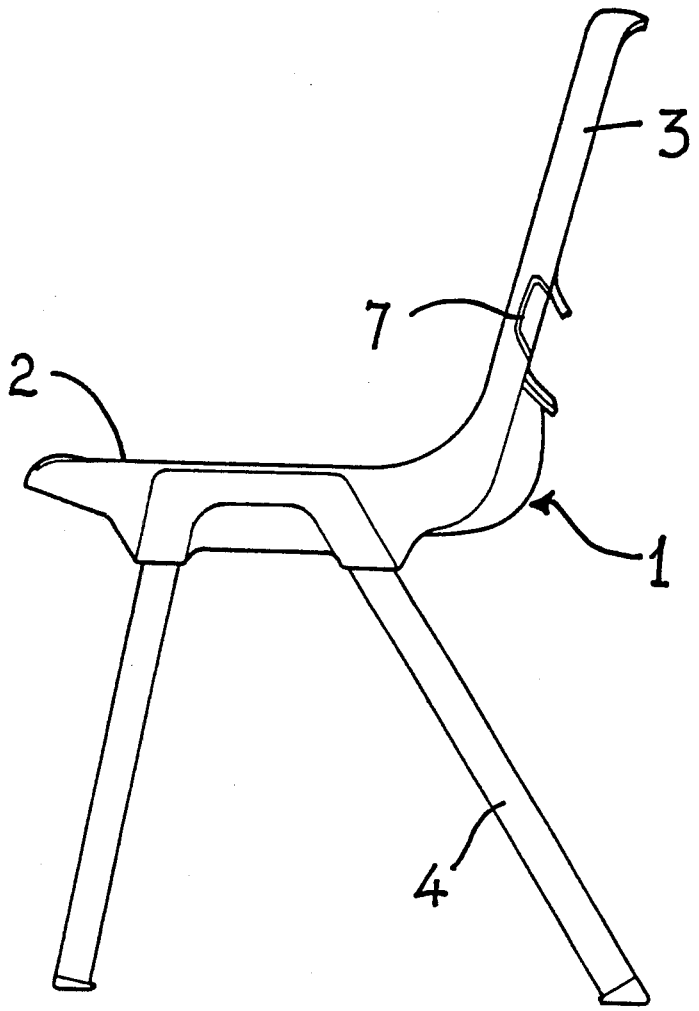
Figure 5:
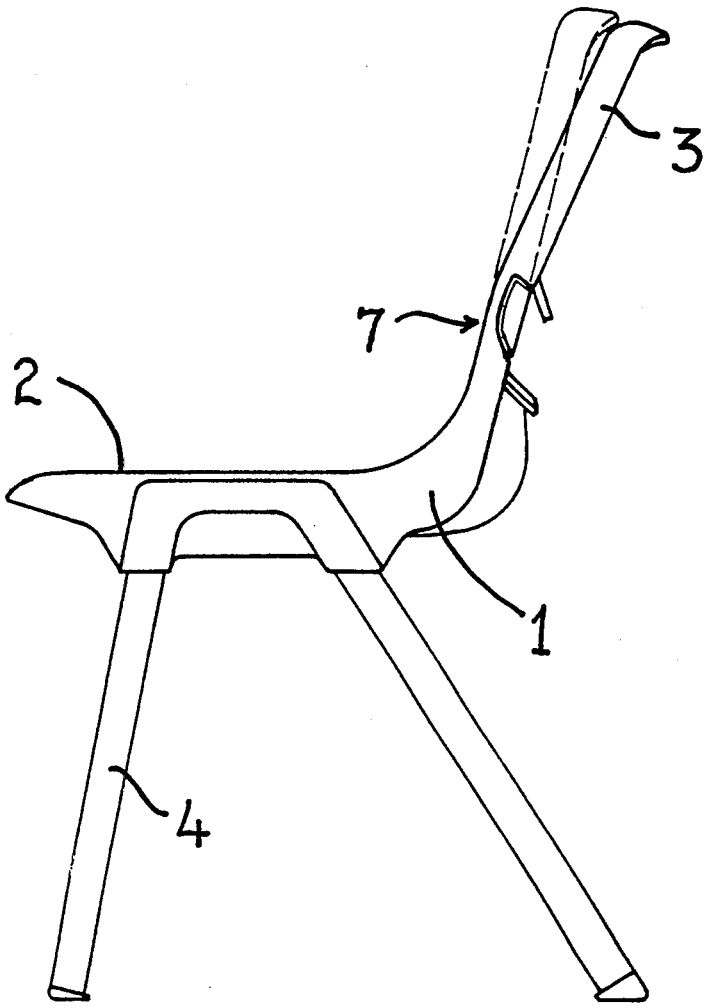
Figure 6:
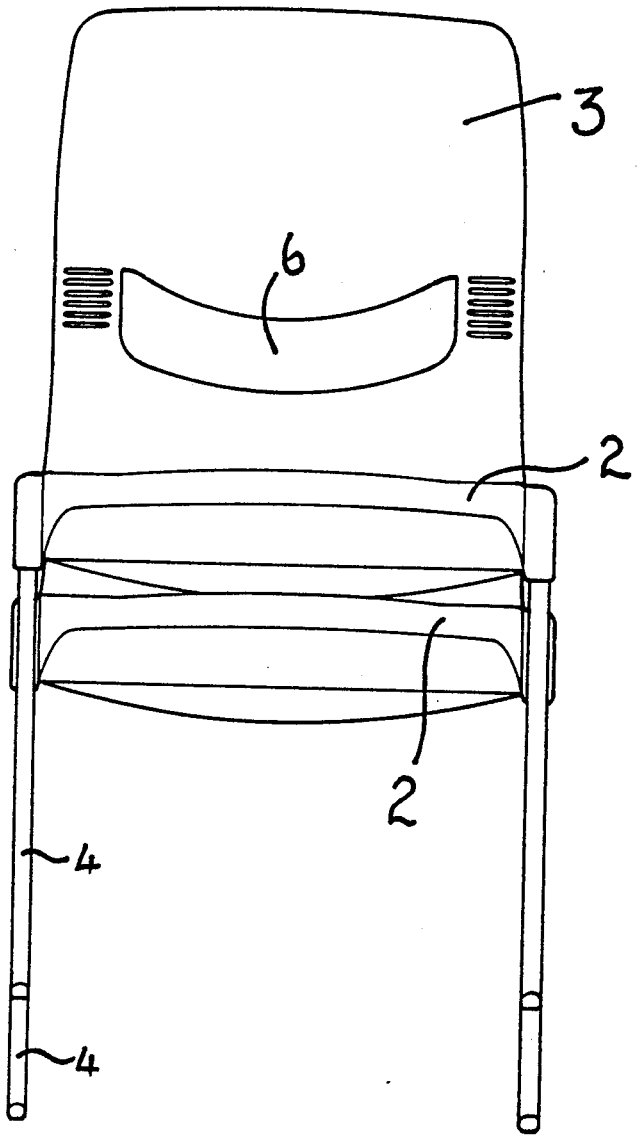
Figure 7:
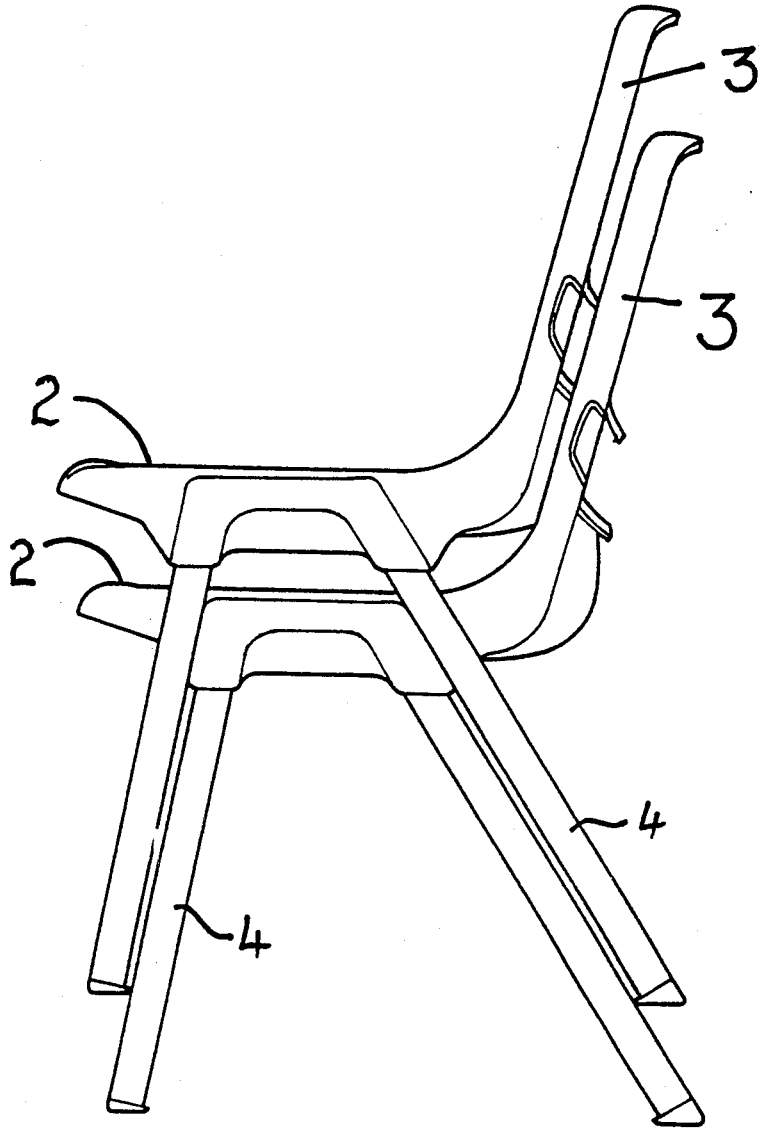
Figure 8:
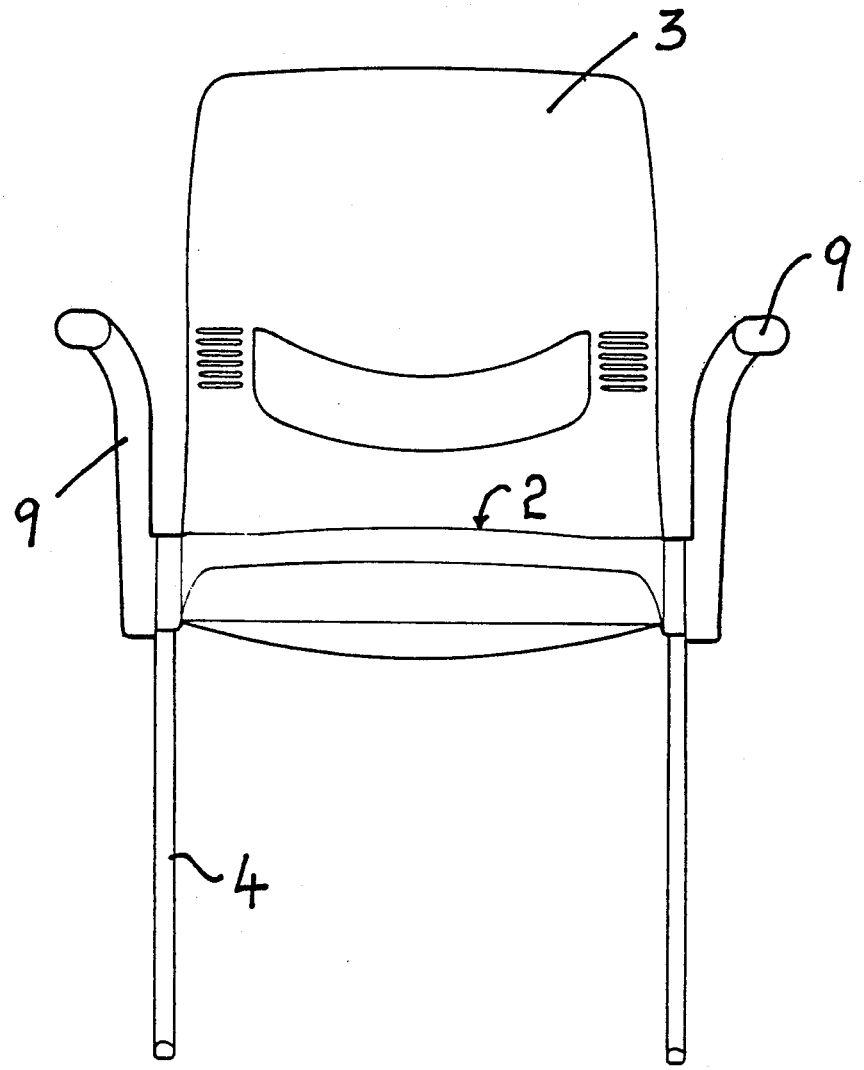
Figure 9:
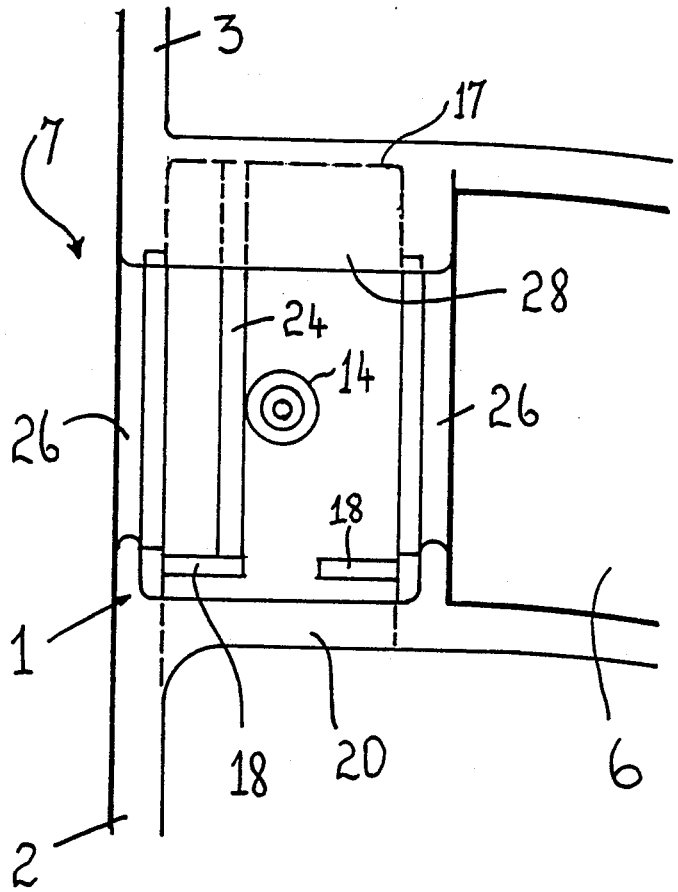
Figure 10:
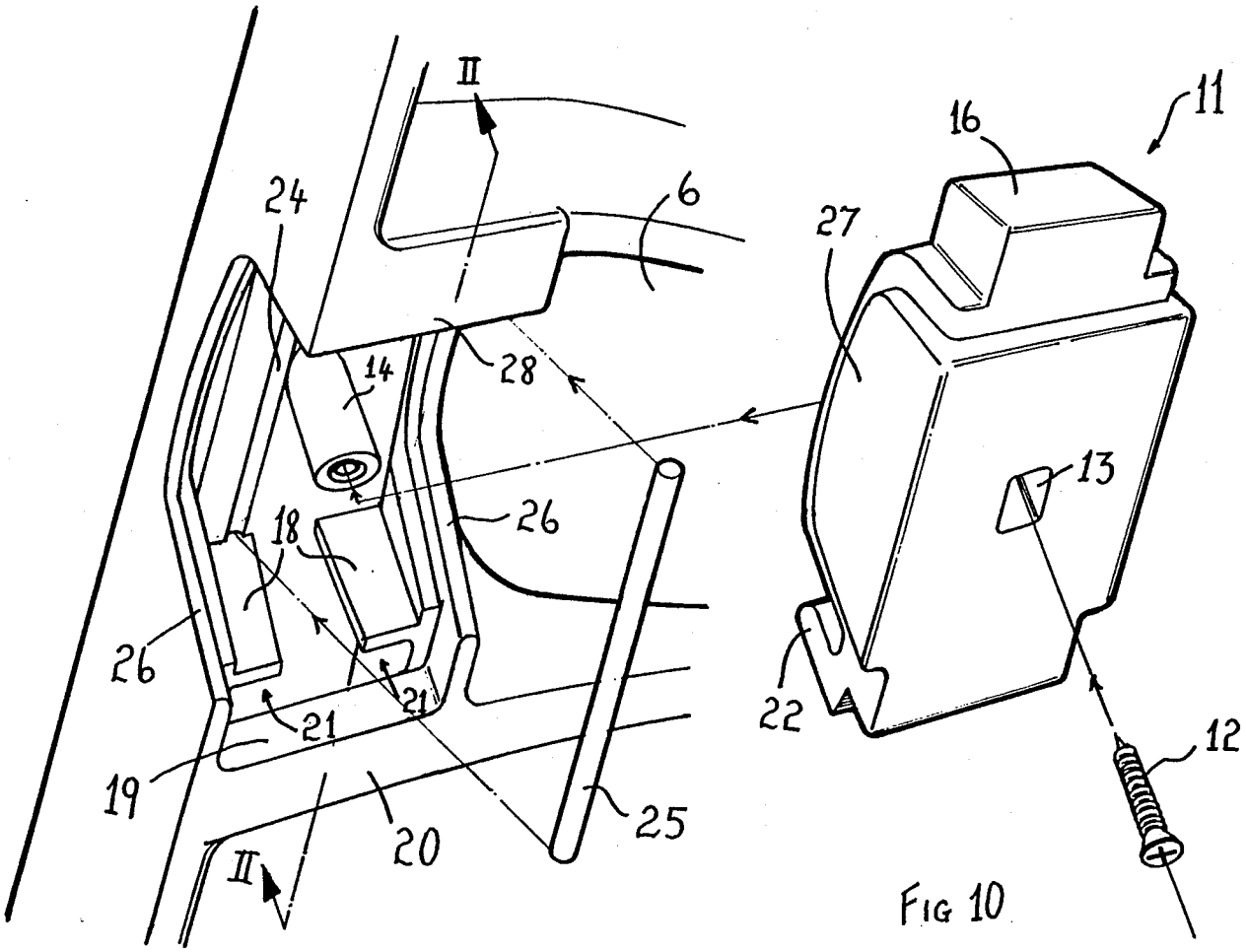
Figure 12:
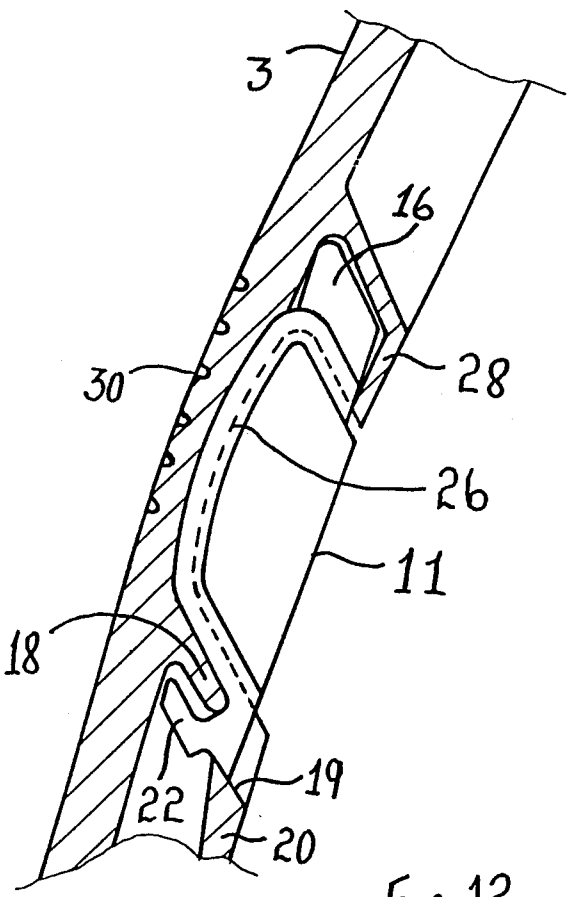
Figure 11:
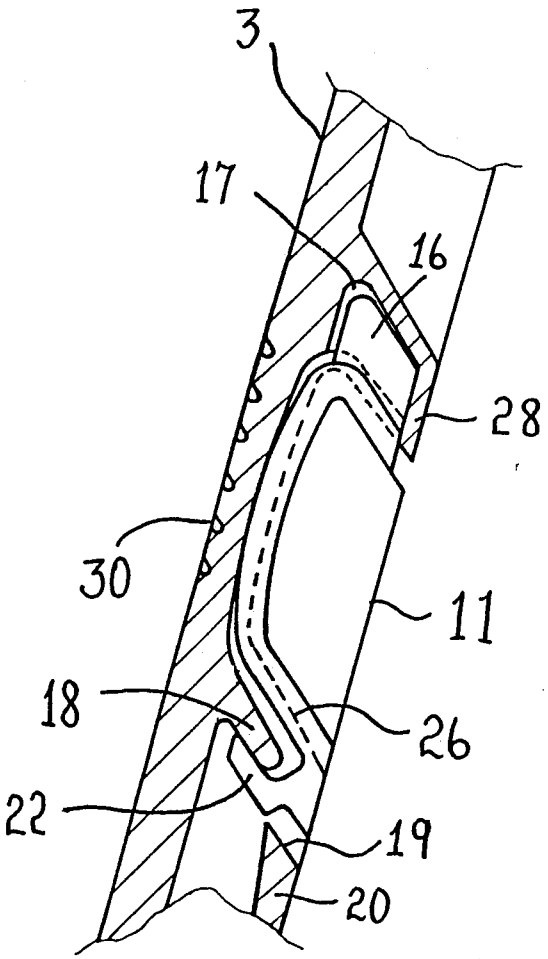
Figures 13, 14, 15:
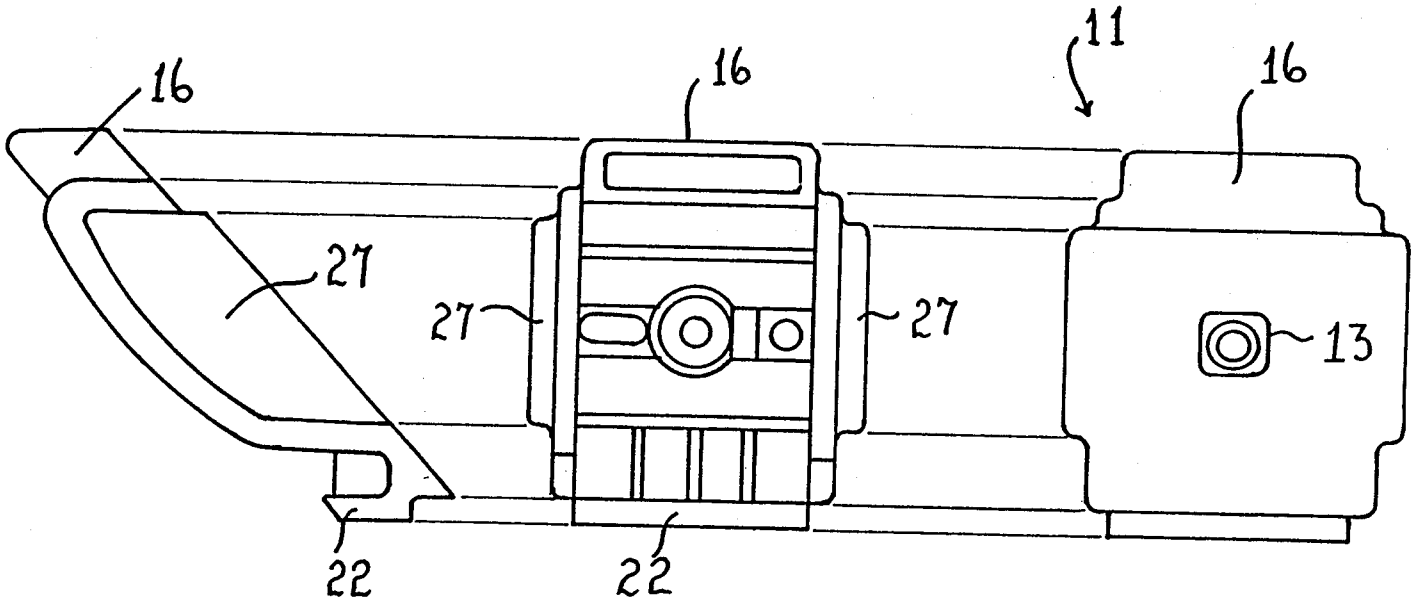
Figure 16:
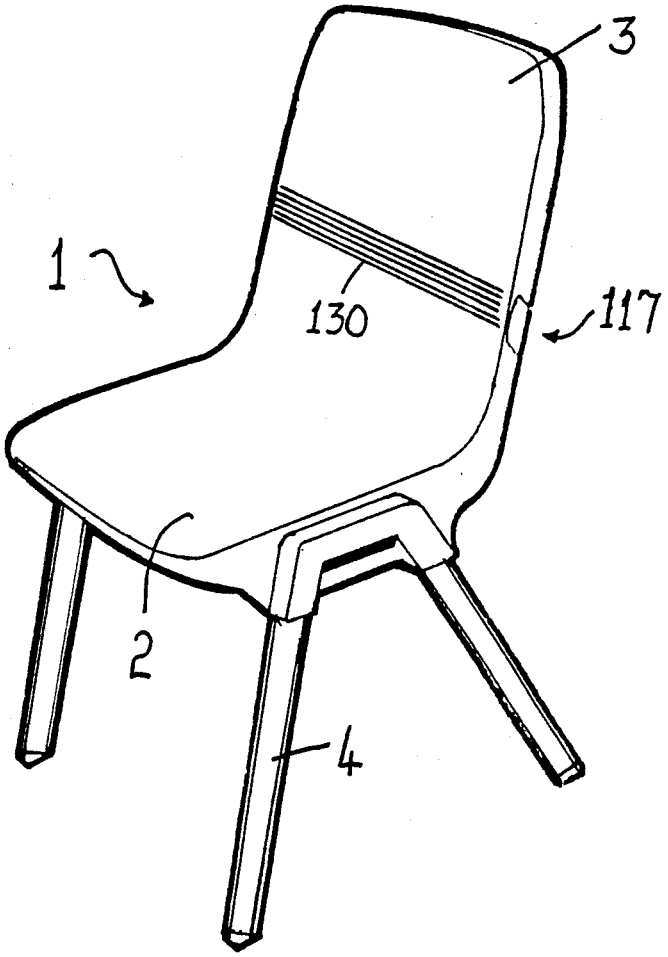
Figure 17:
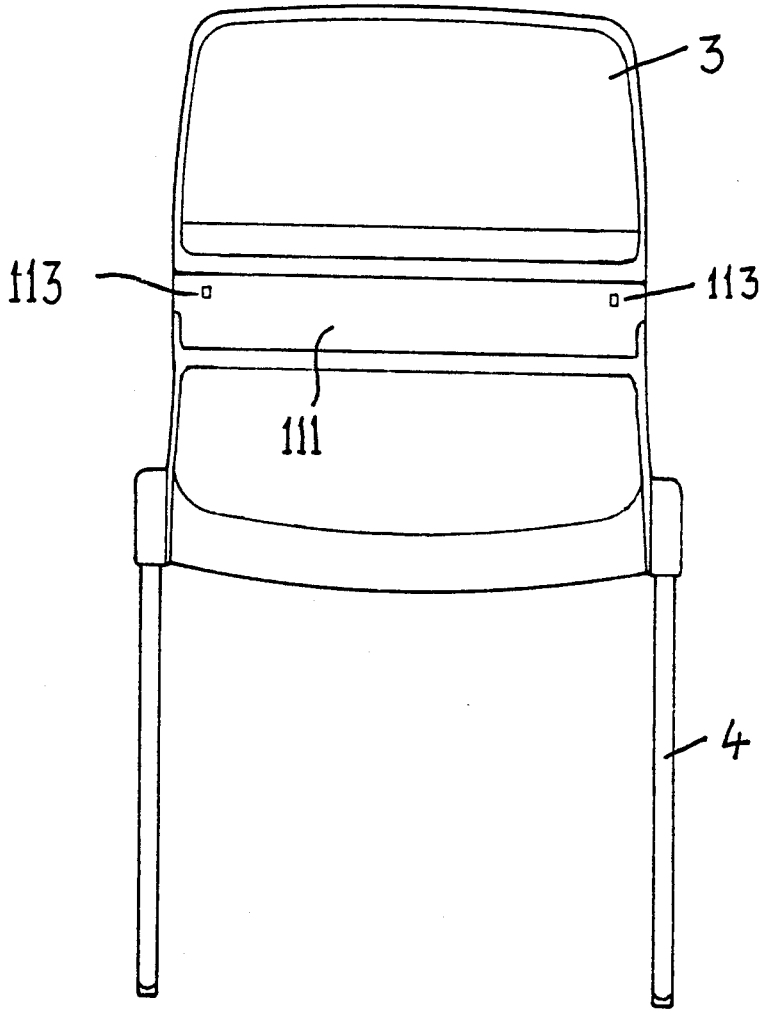
Figure 18:
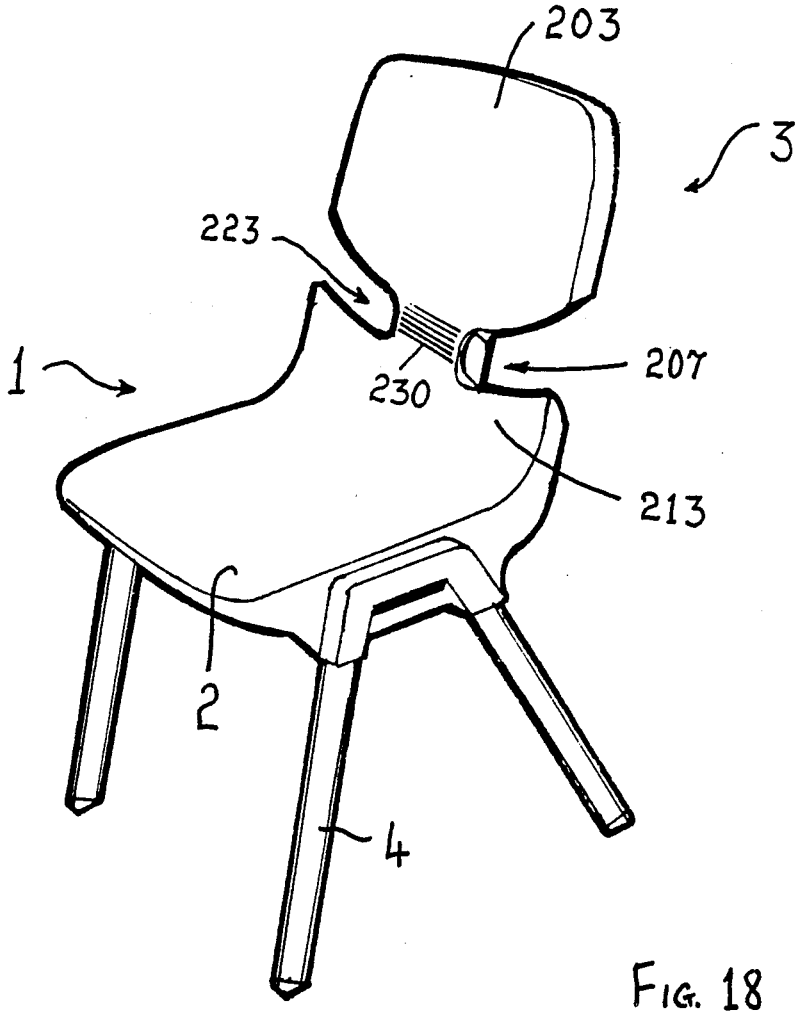
Figure 19:
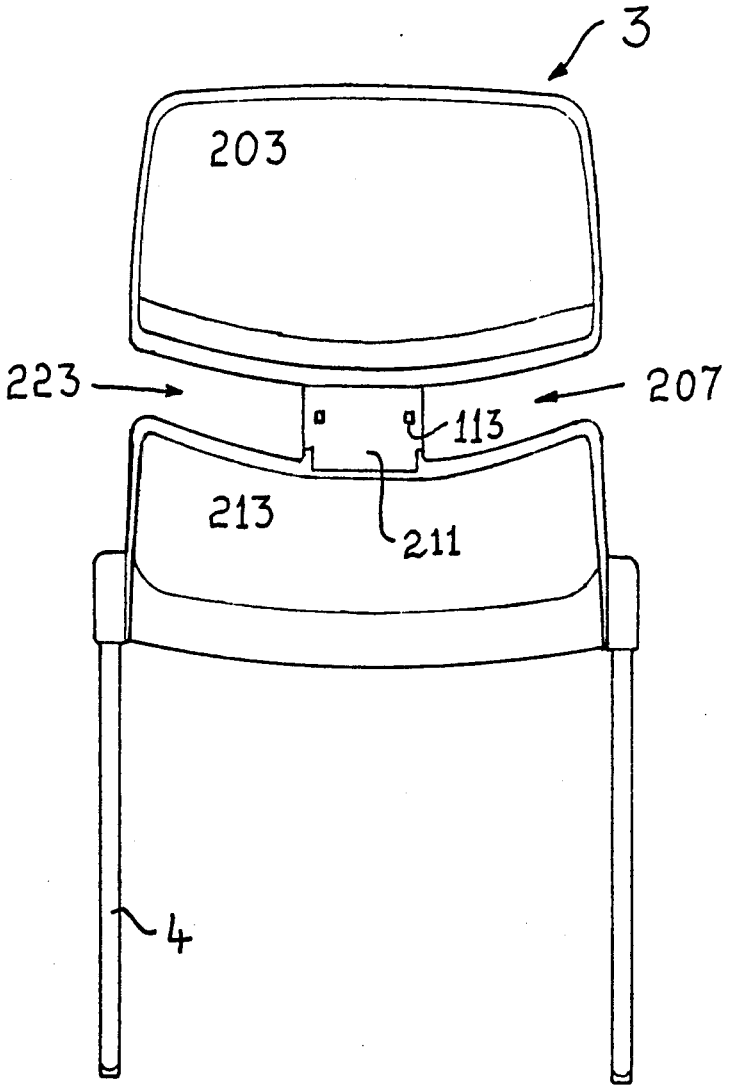

FIG. 4 is a left side elevation of the chair of FIG. 1, the right side elevation being a mirror image thereof, FIG. 5 is a view similar to FIG. 4 but showing the backrest in the rearwardly inclined position, the rest position being illustrated by means of broken lines, FIG. 6 is a front elevation of two of the chairs of FIG. 1 stacked one above the other, FIG. 7 is a left side elevation of the two chairs of FIG. 6, FIG. 8 is a front elevation of a chair of a second embodiment having arms, FIG. 9 is a rear elevation of the left hand hinge arrangement of the chair of FIG. 1, but with the hinge insert absent, FIG. 10 is an exploded perspective view of the hinge arrangement of FIG. 9, FIG. 11 is a cross-sectional view taken along the line II—II of FIG. 10 and showing the backrest in its rest position, FIG. 12 is a view similar to FIG. 11 but showing the backrest in its rearwardly inclined position, FIG. 13 is a rear elevation of the hinge insert illustrated in FIG. 10, FIG. 14 is a front elevation of the hinge insert of FIG. 13, FIG. 15 is a side elevation of the hinge insert of FIG. 13, FIG. 16 is a left front perspective view of a chair of a third embodiment having a single hinge arrangement, FIG. 17 is a rear elevation of the chair of FIG. 16, FIG. 18 is a left front perspective view of a chair of a fourth embodiment having a single hinge arrangement, and FIG. 19 is a rear elevation of the chair of FIG. 18.

As best seen in FIGS. 1 to 4, the chair of the preferred embodiment is formed by a moulded plastics shell 1 having a seat 2 and a backrest 3. Four tubular metal legs 4 are provided with the upper portion of the legs 4 being located within sockets (not illustrated) formed at the sides of the seat 2.

Figure 3:
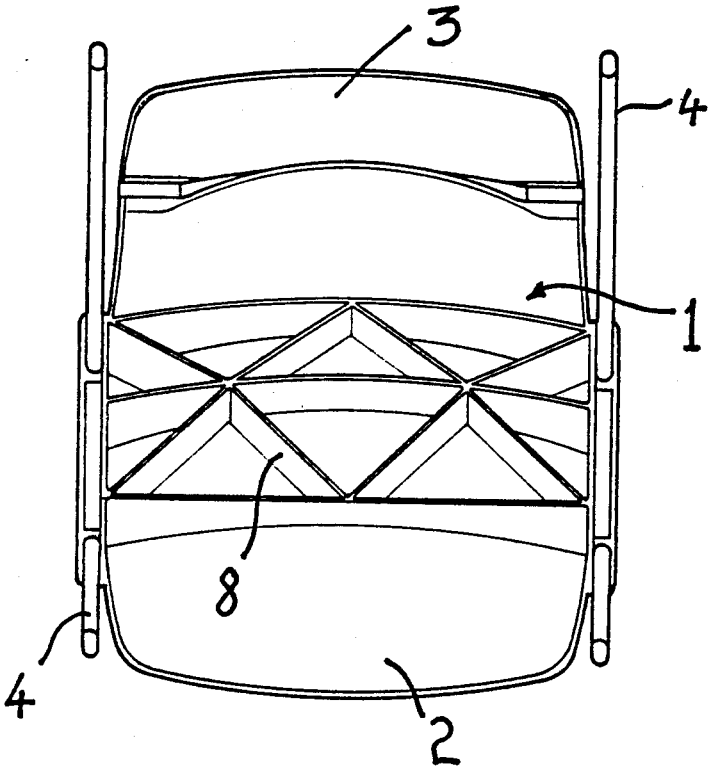
FIG. 3 is an inverted plan view of the chair of FIG. 1.

The shell 1 is provided with a central opening 6 which separates the seat 2 from the backrest 3. To either side of the central opening 6 is one of a pair of moulded hinge arrangements 7 which interconnect the seat 2 and backrest 3. As best seen in FIG. 3, the underside of the seat 2 is provided with a plurality of strengthening ribs 8 which distribute the mechanical load of the weight of the sitter from the shell 1 and seat 2 to the legs 4.

Turning now to FIGS. 4 and 5, in FIG. 4 the backrest 3 is illustrated in the rest position adopted in the absence of a sitter. However, as illustrated in FIG. 5 the backrest 3 is moveable into a rearwardly inclined position illustrated by full lines through the rearward movement of the back of a sitter (not illustrated). The rest position of the backrest 3 is illustrated by broken lines in FIG. 5.

FIGS. 6 and 7 illustrate the stacking ability of a plurality of the chairs of FIGS. 1 to 5 whilst FIG. 8 illustrates a second embodiment in the form of an armchair developed from the side chair of FIGS. 1 to 7. The armchair of FIG. 8 has a pair of armrests 9.

The construction of the hinge arrangement 7 located to either side of the central opening 6 will now be described with reference to FIGS. 9 to 15. The construction of each of the hinge arrangements 7 is substantially identical, however, only the hinge arrangement located to the left side of the chair is illustrated in detail.

As best seen in FIG. 10, the hinge arrangement 7 is substantially formed from two parts. The major part is a recess 10 formed in the shell 1 which opens rearwardly and receives a hinge insert 11. The hinge insert 11 is maintained in the recess 10 by means of a fastener 12 which passes through a central aperture 13 in the insert 11 and is received in a boss 14 formed in the interior of the recess 10.

The insert 11 has an upwardly directed, substantially rectangular protrusion 16 which is received in a downwardly directed slot 17 formed in the shell 1. The slot 17 is best seen in FIG. 11 and is indicated by broken lines in FIG. 9. As best seen in FIG. 10, within the recess 10, and adjacent the lower end thereof, are located a pair of opposed shelves 18. Between the shelves 18 and the upper surface 19 of a cross bar 20, is a space 21 which is shaped to receive a forwardly directed ledge 22 formed on the underside of the insert 11.

A substantially vertically extending groove 24 is located in the recess 10 and is shaped to receive a length of wire 25 if additional stiffening is required for the hinge arrangement 7. Where a lesser degree of stiffening or resilience for the hinge arrangement 7 will suffice, the wire 25 can be omitted. The sides of the recess 10 are generally U-shaped as indicated at 26 and correspond in shape with generally C-shaped side portions 27 on the hinge insert 11. A sufficient gap is left between the side portions 27 and the U-shaped sides 26 in order to prevent clothing or fingers being accidentally pinched in the gap between these parts as the backrest 3 flexes with respect to the seat 2.

The operation of the hinge arrangement 7 is best understood with reference to FIGS. 11 and 12 which respectively show the backrest in the rest position and the rearwardly inclined position.

In the rest position illustrated in FIG. 11, the rear surface of the protrusion 16 abutts the forward surface of a downwardly inclined lip 28. In addition, the upper surface of the ledge 22 is abutting the lower surfaces of the shelves 18. In this way, two stop limits for the forward movement of the backrest 3 are provided.

As seen in FIG. 12, when the backrest 3 is pushed rearwardly, flexure of the shell 1 at the location of the hinge arrangement 7 is permitted, and a plurality of transverse grooves 30 in the forward surface of the shell 1 assist this flexure. The flexure is permitted to accommodate the intended rearward direction of the backrest 3 until such time as a rearward stop position is reached, as illustrated in FIG. 12.

In the rearward stop position, a forward surface of the protrusion 16 now abutts the forward surface of the slot 17. In addition, the upper surface 19 of the cross bar 20 also comes into contact with the hinge insert 11, as do the upper surfaces of the shelves 18.

A natural resilience for the hinge arrangement 7 is provided by means of the flexure of that portion of the shell 1 which includes the hinge arrangement 7, as the backrest 3 moves rearwardly. Additional resilience can be provided by means of the wire 25 which is deformed from its initial straight position, into a rearwardly facing curved position (not illustrated) as the backrest 3 moves into the position illustrated in FIG. 12. Further details of the hinge insert 11 is illustrated in FIGS. 13 to 15.

It will be appreciated that the above-described hinge arrangement provides a number of very important advantages. Because of the stops inherent in the forward or rest position of the backrest 3, the shell 1 is not liable to be damaged by a person sitting behind the chair and moving the backrest forwardly since such forward motion is strongly resisted. Similarly, the stops inherent in the rearwardly inclined position prevent the backrest 3 being bent rearwardly by such a person. Furthermore, the easy movement of the backrest 3 between the two positions illustrated in FIGS. 11 and 12 means that a sitter experiences an easy "give" to the backrest but a firm stop is experienced at the position of maximum rearward inclination.

It will also be appreciated that the above-described arrangement of a pair of hinges located one to either side of the backrest with an opening located between the hinges, is not the only way of constructing a chair in accordance with the present invention. In particular, it will be appreciated that the desired flexing ability of the backrest 3 can be achieved with a single hinge arrangement as illustrated in FIGS. 16 to 19.

In the chair of the third embodiment of FIGS. 16 and 17, a single hinge arrangement 117 is provided which extends across the width of the backrest 3. The hinge insert 111 is similarly extended in width and retained in place by two fasteners (not illustrated) which are each received in one of a corresponding pair of apertures 113. In all other respects the hinge 117 of FIGS. 16 and 17 is substantially similar to the hinge 7 of FIGS. 9 to 12. The grooves 30 of FIGS. 11 and 12, for example, now extend as grooves 130 across the width of the backrest 3.

Turning now to FIGS. 18 and 19, a chair of a fourth embodiment, again having only a single hinge 27 is illustrated. In this embodiment the upper portion 203 of the backrest 3 is separated from the lower portion 213 of the backrest 3 by a waisted portion 223 which comprises the hinge arrangement 207 interconnecting the two portions 203, 213 of the backrest 3. Again the grooves 230 extend across the front of waisted portion 223. The insert 211 also extends across the waisted portion 223 and is provided with a pair of apertures 113 as in FIG. 17. In all other respects, apart of a reduced length, the hinge arrangement 207 is substantially similar to the hinge arrangement 117.

The foregoing describes only some embodiments of the present invention and modifications, obvious to those skilled in the art, can be made thereto without departing from the scope of the present invention.

What I claim is:

1. A moulded plastic chair having a seat and a backrest moulded as a single shell with said backrest being connected to said seat by a resilient hinge means at least a portion of which is moulded together with said shell;

wherein said backrest is movable by the action of said hinge means between a rest position adopted by the backrest in the absence of a sitter, and a rearwardly inclined position into which said backrest is resiliently urged by rearward movement of the back of a sitter;

wherein said chair is provided with two pairs of mating stop surfaces, one of said stop surface pairs limiting the forward motion of said backrest in said rest portion of said stop surface pairs limiting the rearward motion of said backrest in said rearwardly inclined position; and wherein said hinge means includes a recess facing towards the rear of said backrest, and an insert located in said recess, each stop surface pair being formed by a corresponding portion of said recess and a cooperating portion of said insert.

2. A chair as claimed in claim 1 wherein a resilient member is located in said recess, and retained therein by said insert to resiliently bias said backrest into said rest position.

3. A chair as claimed in claim 2 wherein said insert is retained in said recess by a fastener passing through said insert and into said backrest.

4. A chair as claimed in claim 1, 2, or 3 wherein the front surface of said backrest opposite said recess is provided with a plurality of substantially horizontal grooves.

5. A chair as claimed in claim 1 wherein said chair is able to be stacked upon a like chair.

6. A chair as claimed in claim 1 wherein said hinge means comprises a single hinge arrangement.

7. A chair as claimed in claim 1 wherein said hinge means comprises two hinge arrangements located one to either side of a central opening in said backrest.

8. A moulded plastics chair having a seat and a backrest moulded as a single shell with said backrest being connected to said seat by a resilient hinge means moulded together with said shell; wherein said backrest is movable by the action of said hinge means between a rest position adopted by the backrest in the absence of a sitter, and a rearwardly inclined position into which said backrest is resiliently urged by rearward movement of the back of a sitter; wherein said chair is provided with two pairs of mating stop surfaces, one of said stop surface pairs limiting the forward motion of said backrest in said rest position and the other of said stop surface pairs limiting the rearward motion of said backrest in said rearwardly inclined position; and wherein said hinge means includes a recess facing towards the rear of said backrest and an insert located in said recess; each said stop surface pair being formed by a corresponding portion of said recess and a co-operating portion of said insert.

* * * * *